US007322831B1

(12) United States Patent
Peng

(10) Patent No.: US 7,322,831 B1
(45) Date of Patent: Jan. 29, 2008

(54) MATRIX BOARD-TO-BOARD CONNECTOR

(75) Inventor: Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/488,030

(22) Filed: Jul. 18, 2006

(51) Int. Cl.
*H01R 12/00* (2006.01)

(52) U.S. Cl. ..... 439/66; 439/591; 439/862

(58) Field of Classification Search ..... 439/66, 439/591, 862, 908, 733.1
See application file for complete search history.

(56) References Cited

U.S. PATENT DOCUMENTS 4,961,709 A * 10/1990 Noschese ..... 439/66
6,132,222 A * 10/2000 Wang et al. ..... 439/70
6,672,876 B1 * 1/2004 Takekoshi ..... 439/66
6,790,102 B2 * 9/2004 Stillabower et al. ..... 439/856
2005/0130456 A1 * 6/2005 Haga ..... 439/66
2005/0208796 A1 * 9/2005 Yoshida et al. ..... 439/82
2005/0277306 A1 * 12/2005 Millard et al. ..... 439/10
2006/0210237 A1 * 9/2006 Soeta ..... 385/147

* cited by examiner

*Primary Examiner*—Tho D. Ta
*Assistant Examiner*—Vanessa Girardi
(74) *Attorney, Agent, or Firm*—Rosenberg, Klein & Lee

(57) ABSTRACT

A matrix board-to-board connector includes a plurality of contacts and an insulating housing. Each contact has a retaining board, a first contacting portion defined at a bottom end of the retaining board, and a second contacting portion defined at an opposite end of the retaining board. The second contacting portion spirals up and defines a second pressing portion at the top end. A plurality of receiving cavities are formed in the insulating housing for receiving the contacts. The first contacting portion of the connector is connected to the lower circuit board by soldering. The second contacting portion elastically presses the upper circuit board to ensure a firm electrical connection between the upper circuit board and the lower circuit board.

7 Claims, 6 Drawing Sheets

MATRIX BOARD-TO-BOARD CONNECTOR

BACKGROUND OF THE INVENTION

1. Field of the Invention

The present invention relates to a connector, and more particularly to a matrix board-to-board connector for electrically connecting two circuit boards.

2. The Related Art

A matrix board-to-board connector is widely used in electronic devices for electrically connecting one circuit board with another circuit board. As electronic products become smaller and smaller, contacts in the connector are much denser, so matrix board-to-board connectors are developed.

A conventional matrix board-to-board connector includes a first connector and a second connector. The first connector and the second connector are soldered to a different circuit board respectively. The first connector has a first housing with a plurality of first contacts positioned therein. The second connector has a second housing with a plurality of second contacts positioned therein. The first contacts are inserted into the second contacts, thereby, the two connectors are electrically connected and the two circuit boards are electrically connected.

However, the matrix board-to-board connector is connected to the circuit board by soldering, the contacts are densely received in the connector, so the soldering is insufficient to some contacts or some contacts are soldered together unintentionally; as a result, the electrical signals are not exact and stable or a short circuit is caused to make the electronic device break down. Moreover, the contacts are positioned in the housing, when one of the contacts is damaged, it is not convenient to take the damaged contact out, so the whole matrix board-to-board connector is replaced and the cost of the electronic device is raised.

SUMMARY OF THE INVENTION

Accordingly, an object of the present invention is to provide a matrix board-to-board connector, the matrix board-to-board connector includes a plurality of contacts and an insulating housing. Each contact has a retaining board, a first contacting portion extending downward from a bottom end of the retaining board, a connecting portion extending upward and then bends toward one side of the retaining board. A second contacting portion extends from the end of the connecting portion and is vertical to the retaining board, the second contacting portion gradually spirals up to define a second pressing portion at the top end. A plurality of receiving cavities are formed in the insulating housing, each receiving cavity going through the insulating housing. The first contacting portion of each contact is received in the receiving cavity respectively, the free end of the first contacting portion projecting from the lower surface of the insulating housing, the second contacting portion projecting from the upper surface of the insulating housing.

In use, the lower surface of the connector is connected to the lower circuit board by soldering, the upper surface is connected to the upper circuit board through the second pressing portion of the second contacting portion, the second contacting portion is compressed and an elastic deformation is generated, so the compressed second contacting portion elastically presses the upper circuit board, and the elastic connection is firm, so the electrical connection between the upper circuit board and the lower circuit board is stable.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
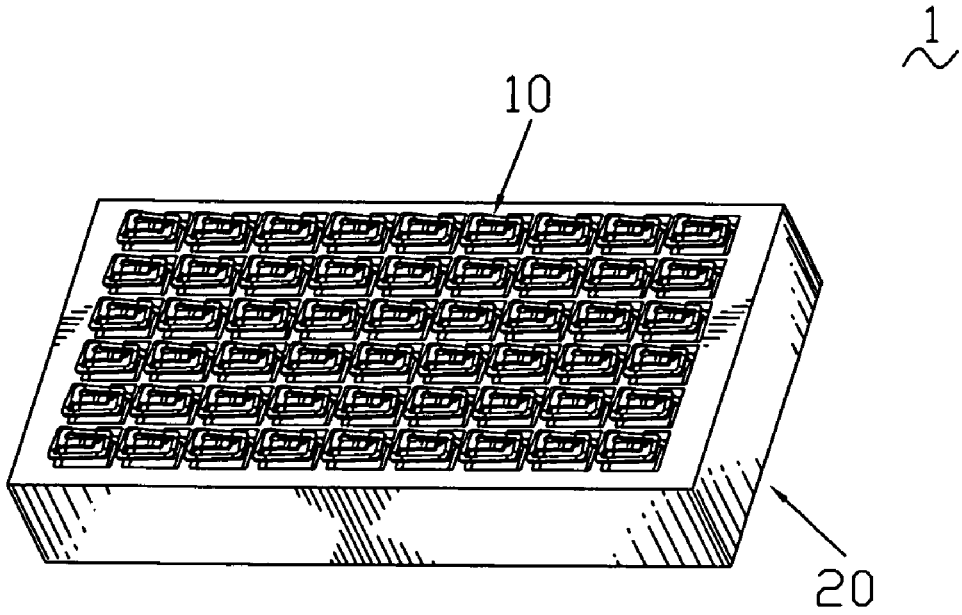
FIG. 1 is a perspective view of a first embodiment of a matrix board-to-board connector of the present invention.
Figure 2:
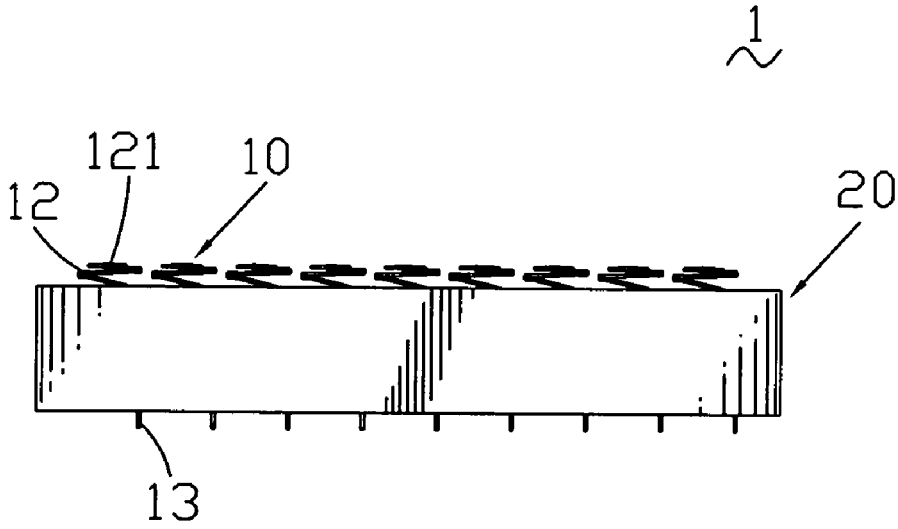
FIG. 2 is a front view of FIG. 1.
Figure 3:
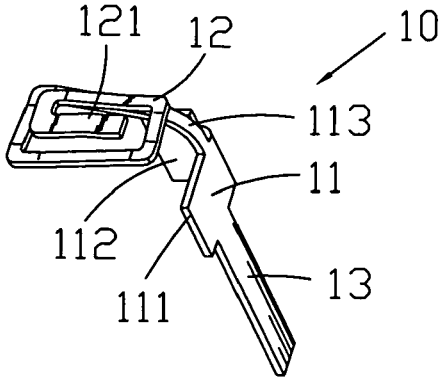
FIG. 3 is a perspective view of a contact shown in FIG. 1.

Please refer to FIGS. 1-2, a first embodiment of the present invention is described in detail. The matrix board-to-board connector 1 includes a plurality of contacts 10 and an insulating housing 20 receiving the contacts. Then referring to FIG. 3, the contact 10 has an oblong retaining board 11. A bottom end of the retaining board 11 extends downward to define a first contacting portion 13. The opposite end of the retaining board 11 extends upward and then bends toward one side of the retaining board 11 to define a connecting portion 113. The end of the connecting portion 113 extends vertically to the retaining board 11 to define a second contacting portion 12. The second contacting portion 12 gradually spirals up for two circles and defines a second pressing portion 121 at the top end thereof. A front end of the retaining board 11 projects forward to define an inlay board 111, the opposite end extends vertically to the retaining board 11 and toward the second contacting portion 12 to define a restricting board 112.

Figure 4:
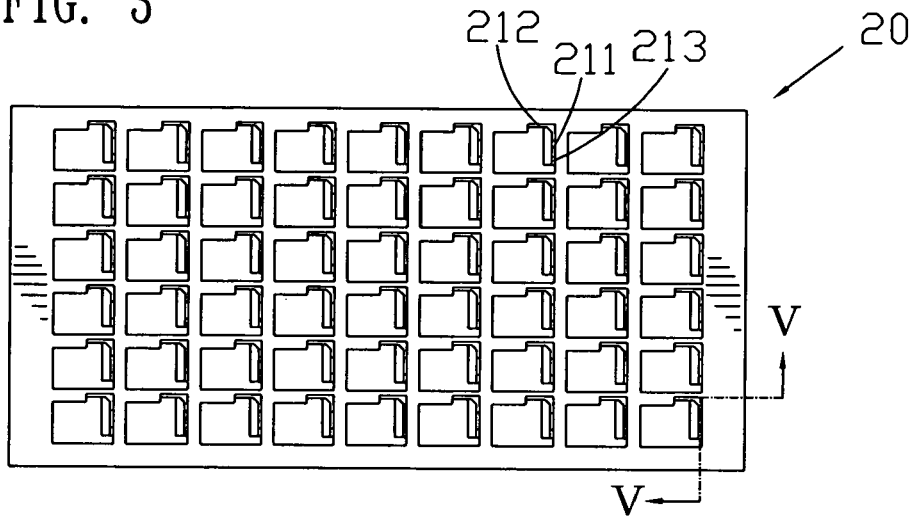
FIG. 4 is a top plan view of an insulating housing shown in FIG. 1.
Figure 5:
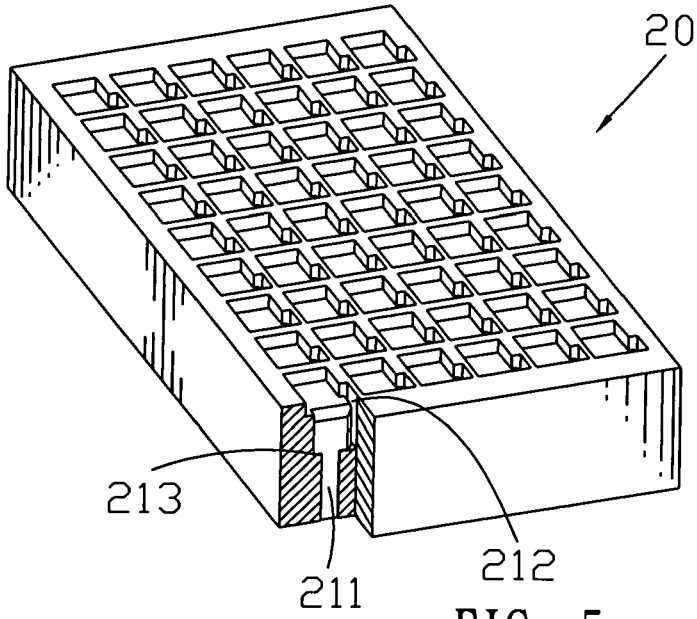
FIG. 5 is a perspective view showing partial cross-sectional view of the insulating housing showing in FIG. 4.

Referring to FIGS. 4-5, a plurality of receiving cavities 211 are disposed in the insulating housing 20 for receiving the contacts 10. A receiving cavity 211 is a slot and goes through the insulating housing 20. One end of the receiving cavity 211 has a restricting block 213 for blocking the inlay board 111. A restricting cavity 212 is disposed at the opposite end of the receiving cavity 211 and communicates with the receiving cavity 211, the restricting cavity 212 is vertical to the receiving cavity 211, the depth of the restricting cavity 212 is about the height of the restricting board 112 for receiving the restricting board 112.

When assembling the connector 1, the first contacting portion 13 of the contacts 10 are inserted into the receiving cavity 211 of the insulating housing 20, then the restricting board 112 is received in the restricting cavity 212 and the second contact 12 projects from the upper surface of the insulating housing 20.

In use, the lower surface of the connector 1 is connected to the lower circuit board (not shown) by soldering, the upper surface is connected to the upper circuit board (not shown) through the second pressing portion 121 of the second contacting portion 12, the second contacting portion 12 is compressed and an elastic deformation is generated, so the compressed second contacting portion 12 elastically presses the upper circuit board, the elastic connection is firm, so the electrical connection between the upper circuit board and the lower circuit board is stable.

Figure 6:
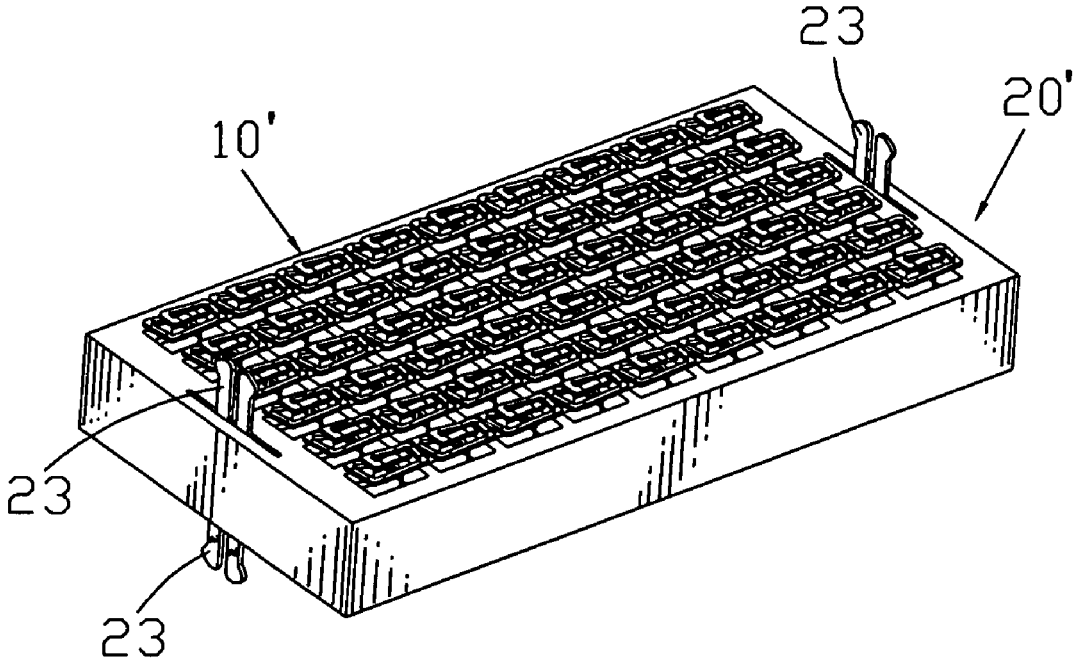
FIG. 6 is a perspective view of a second embodiment of a matrix board-to-board connector of the present invention.
Figure 7:
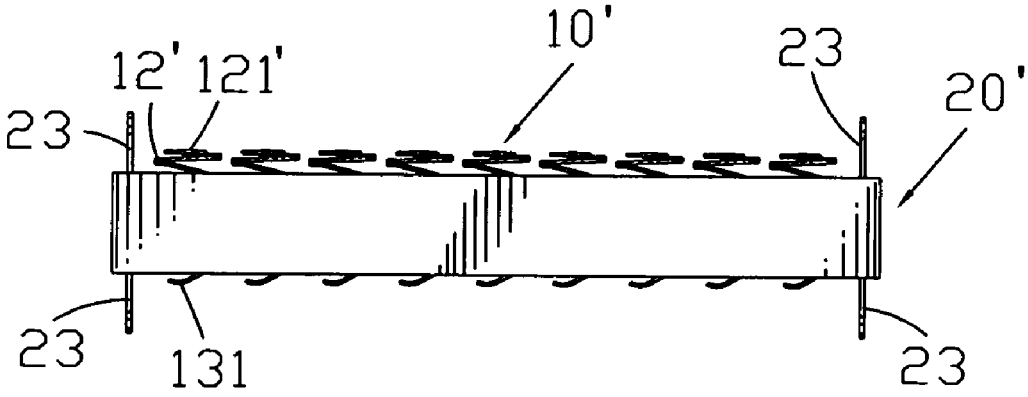
FIG. 7 is a front elevational view of FIG. 6.
Figure 8:
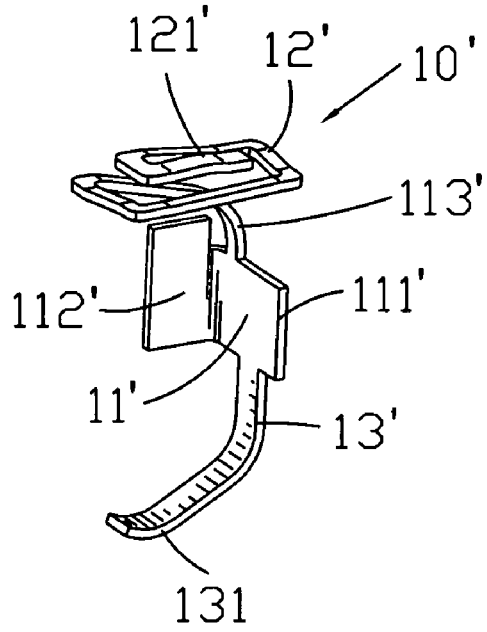
FIG. 8 is a perspective view of a contact shown in FIG. 6.
Figure 9:
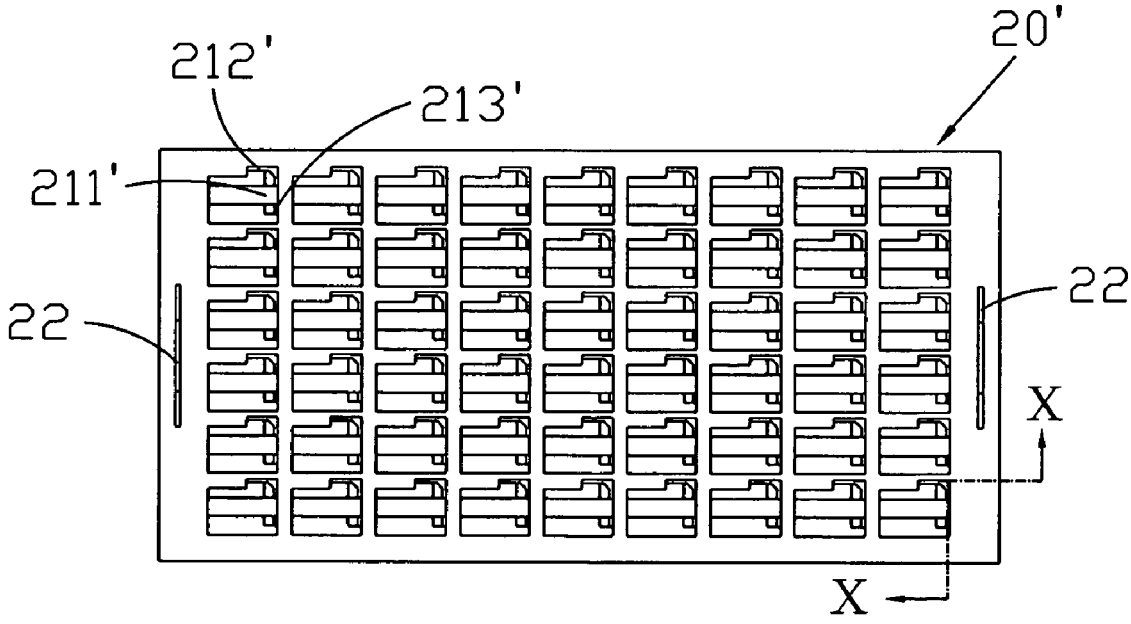
FIG. 9 is a perspective view of a insulating housing shown in FIG. 6.
Figure 10:
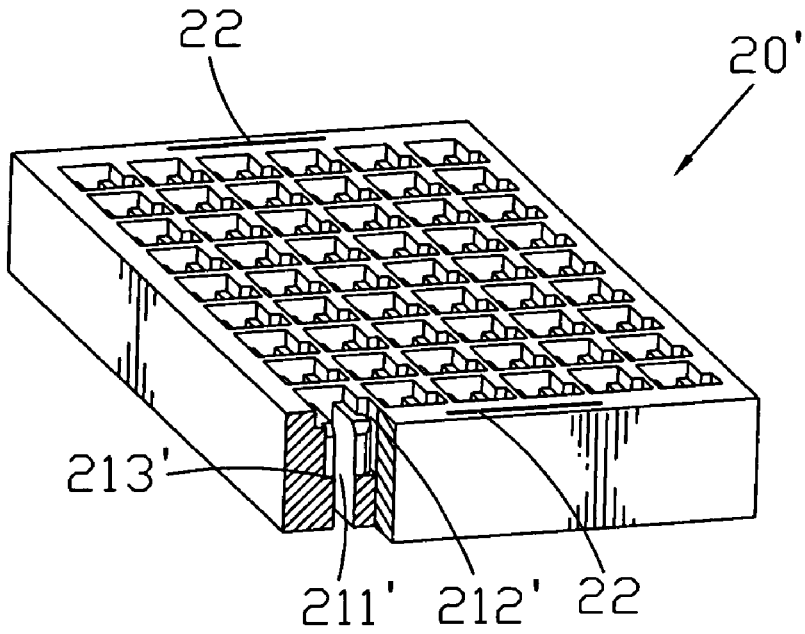
FIG. 10 is a perspective view showing partial cross-sectional view of the insulating housing showing in FIG. 9.
Figure 11:
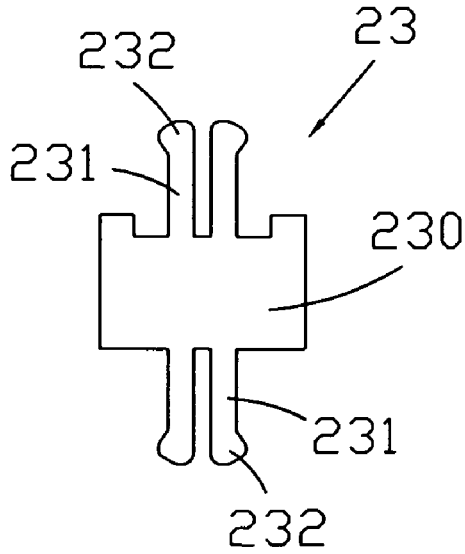
FIG. 11 is a plan view of a lock member shown in FIG. 6.

FIGS. 6-7 show a second embodiment of a matrix board-to-board connector of the present invention. The differences between the second embodiment and the first embodiment are described hereinafter. Please refer to FIG. 8, a first contacting portion 13' of a contact 10' bends toward a second contacting portion 12', then the free end of the first contacting portion 13' bends upward to define a first pressing portion 131 at the bend. As shown in FIG. 9, a restricting cavity 22 is defined at each of two opposite ends of the insulating housing 20' and goes through the insulating housing 20'. As shown in FIGS. 9-10, a receiving cavity 211' is an oblong hole for receiving the retaining board 11' and allowing the contacting portion 13' passing through. FIG. 11 shows a lock member 23 disposed in the restricting cavity 22, each of two ends of the lock member 23 forms a pair of lock arms 231, the free end of each lock arm 231 projects sideward to define a pawl 232.

When assembling the connector 1, the first contacting portion 13' of the contacts 10' are inserted into the receiving cavity 211' of the insulating housing 20', and the first pressing portion 131 projects from the lower surface of the insulating housing 20', then the restricting board 112' is received in the restricting cavity 212' and the second contacting portion 12' projects from the upper surface of the insulating housing 20'.

Figure 12:
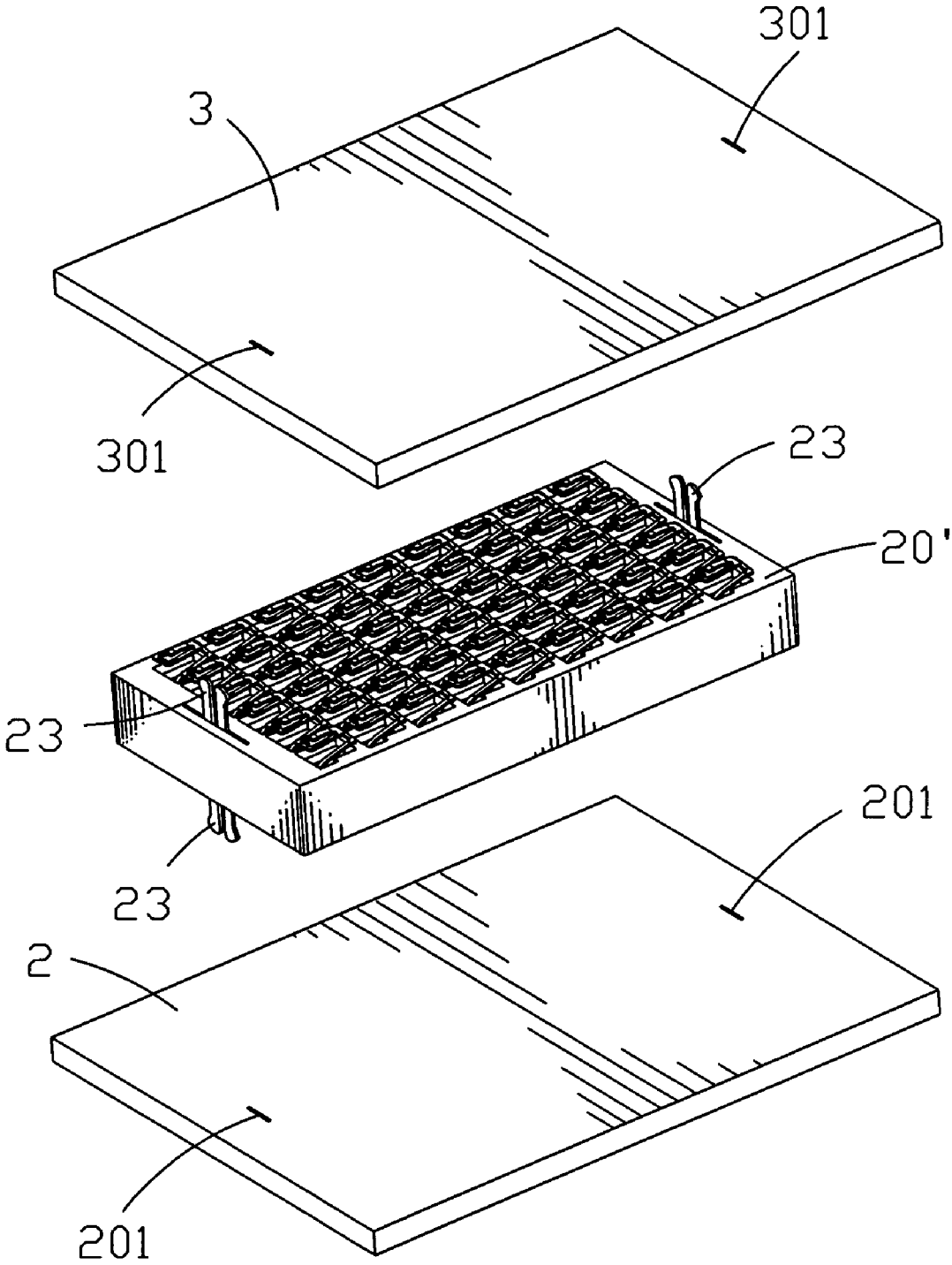
FIG. 12 is an exploded view of the matrix board-to-board connector in accordance with a second embodiment of the present invention with upper and lower circuit board thereof.

Please refer to FIG. 12, in use, the pawls 232 projecting from the lower surface of the connector 1 are inserted into lower inlay cavities 201 disposed in the lower circuit board 2, then the first pressing portions 131' press the lower circuit board 2, the first contacting portions 13' are compressed and an elastic deformation is generated, so the compressed first contacting portions 13' elastically press the lower circuit board 2, similarly, the compressed second contacting portions 12' elastically press the upper circuit board 3, the elastic connection is firm, thereby, the electrical connection between the upper circuit board 3 and the lower circuit board 2 is stable.

As described above, the matrix board-to-board connector 1 of the present invention electrically connects the circuit boards through the elastic contacts, in which the connection is firm; as a result, the transportation of the electrical signal is more exact and stable and a short circuit can be avoided. Moreover, the connector 1 is easy to be taken apart, it is convenient to take damaged contacts out instead of replacing the whole connector 1, so the cost of the electronic device is escaped.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A matrix board-to-board connector comprising:

a plurality of contacts, each contact having a retaining board, a first contacting portion extending downward from a bottom end of the retaining board, a connecting portion extending upward from one end of the retaining board opposite to the first contacting portion and then bending toward one side of the retaining board, a second contacting portion extending from one end of the connecting portion and being vertical to the retaining board, the second contacting portion gradually spiraling up to define a second pressing portion at a top end, a restricting board extending from a lateral side of, and perpendicular to, the retaining board and further extending vertically toward the second contacting portion, the restricting board and the connecting portion are located on the same side of the retaining board with respect to the first contacting portion; and an insulating housing, a plurality of receiving cavities being formed in the insulating housing for receiving the plurality of contacts, each receiving cavity going through the insulating housing;

wherein the first contacting portion of each contact is received in the receiving cavity respectively, the free end of the first contacting portion projecting from a lower surface of the insulating housing, the second contacting portion projecting from an upper surface of the insulating housing.

2. The matrix board-to-board connector as claimed in claim 1, wherein the first contacting portion is oblong and plane.

3. The matrix board-to-board connector as claimed in claim 1, further comprising a restricting cavity being vertical to the receiving cavity, the restricting cavity being defined at one end of the receiving cavity and communicating with the receiving cavity, wherein the depth of the restricting cavity is about the height of the restricting board for receiving the restricting board.

4. The matrix board-to-board connector as claimed in claim 3, wherein the opposite end of the retaining board extends to define an inlay board.

5. The matrix board-to-board connector as claimed in claim 4, wherein the opposite end of the receiving cavity has a restricting block for blocking the inlay board of the contact.

6. The matrix board-to-board connector as claimed in claim 1, wherein the first contacting portion of the contact bends to form a first pressing portion at the bend thereof.

7. The matrix board-to-board connector as claimed in claim 6, wherein each of two opposite ends of the insulating housing defines a restricting cavity going through the insulating housing, a lock member is disposed in the restricting cavity, each of two ends of the lock member defines a pair of lock arms apart from each other, each lock arm projecting sideward to define a pawl.

* * * * *